United States Patent [19]

Stein et al.

[11] 3,967,682

[45] July 6, 1976

[54] METHOD OF PRODUCING HYDROCARBONS FROM AN UNCONSOLIDATED FORMATION

[75] Inventors: Nathan Stein; John P. Heller, both of Dallas, Tex.

[73] Assignee: Mobil Oil Corporation, New York City, N.Y.

[22] Filed: Apr. 14, 1975

[21] Appl. No.: 567,663

[52] U.S. Cl. ..... 166/278

[51] Int. Cl.[2] ..... E21B 43/04

[58] Field of Search ..... 166/278, 276, 287, 285; 61/36 R

[56] References Cited

UNITED STATES PATENTS

| | | | |
|---|---|---|---|
| 2,076,489 | 4/1937 | Williams | 166/278 X |
| 2,167,190 | 7/1939 | Vietti | 166/278 |
| 2,998,065 | 8/1961 | Hildebrandt | 166/278 |
| 3,102,589 | 9/1963 | Graham et al. | 166/278 |
| 3,194,312 | 7/1965 | Thomas | 166/285 |
| 3,353,599 | 11/1967 | Swift | 166/278 |
| 3,389,752 | 6/1968 | Lebourg | 166/285 |
| 3,756,318 | 9/1973 | Stein et al. | 166/278 |

OTHER PUBLICATIONS

Hall, Jr. et al., "Stability of Sand Arches: A Key to Sand Control," *Journal of Pet. Tech.* July 1970, pp. 821–829.

*Primary Examiner*—Stephen J. Novosad
*Assistant Examiner*—George A. Suckfield
*Attorney, Agent, or Firm*—C. A. Huggett; Henry L. Ehrlich

[57] ABSTRACT

This specification discloses a method of producing hydrocarbons from an unconsolidated hydrocarbon-bearing formation that is penetrated by a well that has an irregular wall adjacent the formation. Granular particles that are water-wet are injected down the well to fill the irregularities in the wall and a packer that has lateral passageways therethrough is set against the well wall. Pressure is applied via the packer to the formation in an amount no greater than the overburden pressure on the formation and hydrocarbons are produced from the formation via the lateral passageways of the packer into the well.

6 Claims, 3 Drawing Figures

METHOD OF PRODUCING HYDROCARBONS FROM AN UNCONSOLIDATED FORMATION

BACKGROUND OF THE INVENTION

This invention relates to the production of hydrocarbons from an unconsolidated hydrocarbon-bearing formation that is penetrated by a well that communicates with the unconsolidated formation.

Hydrocarbons are sometimes found in subterranean unconsolidated formations. Such formations are normally poorly cemented sandstone formations which may in some instances have little or no cementing material holding the sand grains together.

The production of hydrocarbons from unconsolidated formations may result in the production of sand from the formation along with the hydrocarbons. The production of sand is undesirable for many reasons. It is abrasive to components within the well such as tubing, pumps, and valves, and may partially or completely clog the well. Sand production is normally rate-sensitive, that is, no sand may be produced at very low rates while at high rates large quantities of sand may be produced.

Various techniques have been used for controlling the flow of sand from unconsolidated formations. Many of these techniques employ the use of slotted or screened liners or gravel packs to prevent the sand from being transported along with the hydrocarbons into the well. Other techniques make use of consolidating plastic material to cement the grains together and thereby prevent caving.

In U.S. Pat. No. 2,998,065 there is described an invention which relates to a method and apparatus for the completion of wells in unconsolidated sand formations whereby the sand particles in an unconsolidated-producing formation are supported under pressure from within the wellbore in order to prevent their entrainment in fluids flowing from the formation into the well. It is there stated that unconsolidated sand formations can effectively be controlled by the application of force to the walls of the borehole within the formation, thus creating pressures which counteract the pressures tending to break down the formation and cause entrainment of sand particles in he producing fluids. The pressures should be substantially equal to but not in excess of the overburden pressure. A porous-producing medium is positioned in the borehole and expanded to force the medium against the formation so that the sand particles are retained in their original, undisturbed position, to virtually eliminate sand production and the difficulties associated therewith. The porous-producing medium may comprise an expansible perforated sleeve or liner, a bed of gravel, or similar granular material, a tapered production liner, or a bed of metallic burrs or the like which can be forced into the formation and interlocked. In another embodiment, a gravel pack is used as the producing medium and a tubular sleeve is expanded against the gravel pack to create the necessary pressure. Another embodiment is described as being particularly adapted for use in boreholes wherein considerable washout has occured during drilling and wherein the diameter of the borehole within the unconsolidated formation is too large or irregular to permit use of the apparatus described. A perforated production tube sealed at the bottom is lowered into the well and a gravel pack is placed around the production tube by circulating a gravel-laden drilling mud through the annulus of a borehole and withdrawing the liquid free of gravel through the tubing to the surface. Water is then circulated through the borehole to wash any remaining drilling mud from the formation and the gravel pack. A piston is created above the gravel pack by introducing successively finer grades of solid material until an impervious layer several feet thick has been build up, thereby forming a piston. Liquid is introduced into the annulus of the borehole and the weight of the liquid on the piston compresses the gravel pack and forces it outward against the formation, creating the necessary pressure.

In U.S. Pat. No. 3,194,312 there is described an invention which relates to a method and apparatus for the completion and production of oil wells. Formation protecting and production valve units are connected in a conventional string of well casing and are positioned adjacent a producing formation. An expansible jacket is expanded outwardly into fluid-tight protecting and sealing engagment with the surrounding producing formation. While the jacket remains expanded, cement is forced downwardly through the casing string and flows upwardly exteriorly of the casing to cement the casing string within the wellbore. The cement cannot pass between the inflated jacket and the wellbore and thus the producing formation remains permanently free of the cement. Tube ports are provided in the formation protecting and production valve units such that the producing formation is placed in direct communication with the interior of the casing string, allowing the oil to flow from the formation into the casing.

In U.S. Pat. No. 3,756,318 to Nathan Stein and Lloyd G. Jones there is described a well completion system and a process for producing fluids from wells that penetrate unconsolidated formations. A sand retainer is installed adjacent a lower portion of an open production interval to control the production of sand from the zone of the unconsolidated formation that is subject to being invaded by a water cone. Fluids are produced from the well at a rate such that sand arches are formed and the formation is stabilized, thus permitting a high rate of production of hydrocarbons with a minimum production of sand from that portion of the unconsolidated formation above the sand retainer.

The formation of sand arches and the resulting stabilization of unconsolidated formations are discussed in an article entitled "Stability of Sand Arches: A Key to Sand Control", By C. D. Hall, Jr. and W. H. Harrisberger, Journal of Petroleum Technology, July 1970, pp. 821–829, and the aforementioned Stein and Jones patent. Stein and Jones teach that sand arches are formed as the result of cohesion or capillary forces between the sand grains and state that the formation is stabilized as the result of the overburden stress acting on the sand grains in the arch. They indicate that sand arches are the mechanism by which water-wet unconsolidated formations are consolidated, thus allowing hydrocarbon fluids to be produced at high rates therefrom without producing any substantial amount of sand from the formation. In describing an aspect of their invention wherein there has been no substantial disturbance of the unconsolidated formation by the production of fluids therefrom, Stein and Jones teach that it is preferable that the sand arches are formed slowly around each perforation to stabilize the formation. This is done by incrementally increasing the production rate and producing at each rate until sand-free production is obtained. This incremental increase in the production rate is continued until either the flow capacity of the production tubing is reached or until formation stability is no longer attained (sand-free production not attainable). By forming the sand arches in accordance with this procedure, sudden shifts within the formation are avoided thereby lessening the chance of the occurrence of formation failures. In addition, the chance is lessened for a large volume of sand to be produced when the well is first put on production.

SUMMARY OF THE INVENTION

This invention is directed to a method of producing hydrocarbons from a zone of an unconsolidated hydrocarbon-bearing formation that is free of flowable water which formation is penetrated by a well completed as an open hole and wherein the wall of the open hole adjacent the formation is irregular. Water-wet granular particles are injected down the well to make regular the wall of the open hole and a packer is set within the well adjacent the zone and against the wall of the open hole made regular which packer has a plurality of lateral passageways extending therethrough to provide fluid communication intermediate the formation and the interior of the well. Pressure is applied via the packer to the wall of the open hole made regular in an amount no greater than the overburden pressure on the formation and sand arches are formed in the formation to stabilize the formation by producing hydrocarbons at a first rate from the well until sand-free production is attained, producing hydrocarbons at incrementally higher production rates until a production rate is attained at which sand-free production is no longer attained and producing hydrocarbons from the formation via the passageways that extend through the packer at a rate slightly less than the rate at which the sand-free production is no longer attained.

DESCRIPTION OF THE PREFERRED EMBODIMENTS

This invention relates to the production of hydrocarbons from a hyrocarbon-bearing unconsolidated formation and is concerned with stabilizing the formation to control the production of formation particles, hereinafter referred to as "sand" from the formation.

Figure 1:
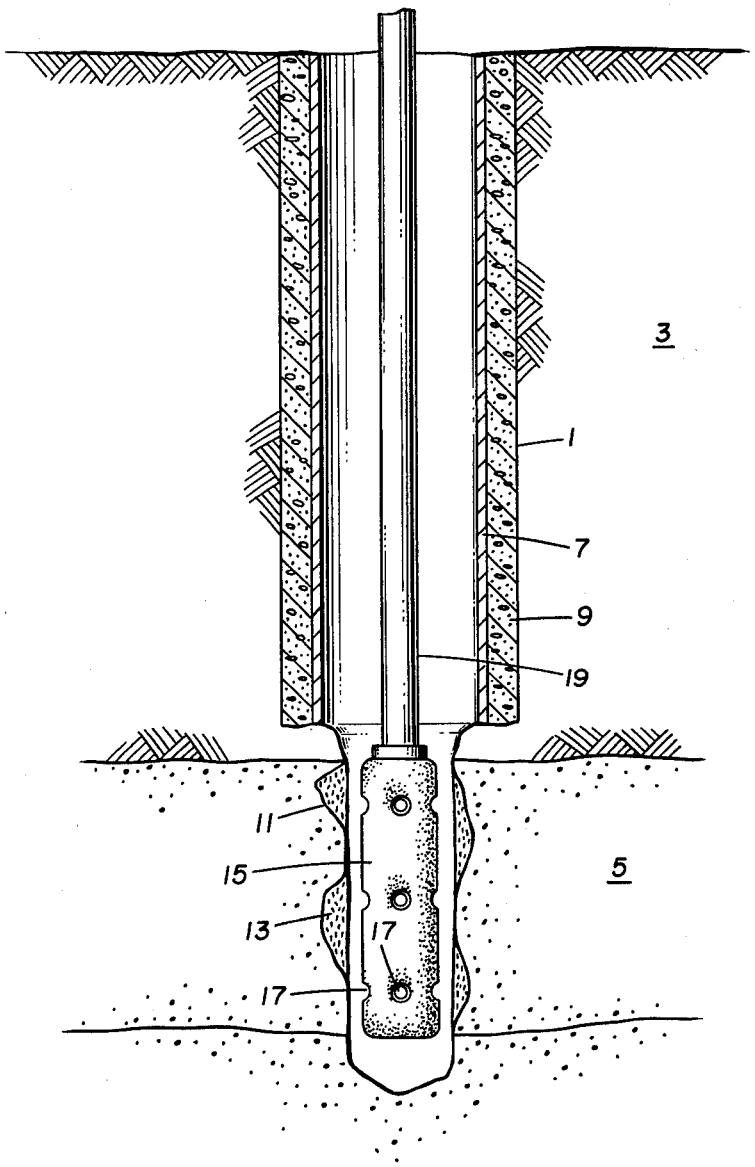
FIG. 1 is a diagrammatic view illustrating a packer having lateral passageways therethrough positioned in a well completed as an open hole having walls made regular by water-wet granular particles.

With reference to FIG. 1 there is illustrated a well 1 which extends from the surface of the earth (not shown) through an overburden 3 into an unconsolidated formation 5 and is completed as an open hole completion. Casing 7 is provided in the well and is supported therein by a cement sheath 9. The lower end of casing 7 is landed at approximately the upper extremity of the unconsolidated formation 5 and the well 1 is uncased adjacent the unconsolidated formation 5. Cavities or washouts 11 are present in the unconsolidated formation 5 making irregular the wall of the well. Such cavities may be formed as a result of the drilling of the well or subsequently as a result of the production and movement of sand as hydrocarbons are produced from the formation.

In accordance with this invention, water-wet granular particles 13 are injected down the well and are deposited in the cavities 11 to provide a regular wall for the portion of the well 1 which extends into the unconsolidated formation 5. An expandable means having lateral passageways therethrough, such as an expandable packer 15 having lateral passageways 17 therethrough, is attached to a tubing string 19 and lowered into the well and positioned adjacent the unconsolidated formation 5. The packer 15 is set in the well and expanded to apply pressure against the wall of the well and thus against the unconsolidated formation 5. The pressure applied against the unconsolidated formation 5 should be no greater than the overburden pressure on the formation but desirably is approximately equal to the overburden pressure. This applied pressure stabilizes the formation and the greater the pressure, up to the overburden pressure, the more stable will be the formation. A pressure greater than the overburden pressure may result in fracturing the formation and reducing the stability thereof. After setting the packer against the wall of the well, hydrocarbons are produced therefrom through the lateral passageways 17 which communicate with the formation and the interior of the well and then are flowed up the well through the production tubing 19 to the surface of the earth and there recovered. Desirably, the hydrocarbons are produced from the unconsolidated formation 5 in a manner which results in slowly forming sand arches in the formation opposite each lateral passageway that communicates with the formation, which sand arches stabilize the formation. The sand arches may be formed slowly by beginning the production of hydrocarbons from the formation and increasing the production rate until a rate is first obtained that results in sand-free production. At this first rate, sand arches are first formed which have sufficient strength to stabilize the formation at the first rate. The production rate is thereafter incrementally increased until a production rate is attained at which sand-free production is no longer attained. This rate is just greater than the maximum sand-free production rate which can be attained by using the sand arches to stabilize the formation. Thereafter, the hydrocarbons are produced from the formation at a production rate slightly less than the rate at which sand-free production is no longer attainable.

The formed sand arches change somewhat in structure to stabilize the formation at different production rates. Therefore, it is desirable in forming the sand arches to increase the production rate to about a maximum rate above which the sand arches are no longer capable of stabilizing the formation. The sand arches that form at this maximum production rate will normally have a span no greater than about 3 inches. The selected spacing of the lateral passageways in the packer should be greater than the span of the sand arches that form at this maximum production rate such that the sand arches that form opposite adjacent lateral passageways do not interfere one with the other and thereby reduce the stability of the formation.

In FIG. 1 the packer 15 is illustrated as having a vertical dimension which is approximately equivalent to the thickness of the unconsolidated formation 5. Unconsolidated formations may be characterized by a sufficiently low water content throughout the vertical thickness of the formation such that if water is present therein it is not moveable or flowable. When producing hydrocarbons from formations that are free of flowable water, it may be desirable that the packer 15 have a vertical dimension approximately equivalent to the thickness of the unconsolidated formation such that hydrocarbons may be produced from the entire vertical thickness thereof. However, it is sometimes desirable to produce from only a selected zone of a formation in which case the packer is selected to have a vertical dimension which corresponds with the vertical dimension of the selected zone. It has been found that the presence of flowable or moveable water in an unconsolidated hydrocarbon-bearing producing formation reduces the cohesion force between the sand grains and thus causes the failure of or prevents the formation of sand arches. Thus, when there is bottom water present in an unconsolidated formation, it is desirable to use a packer that has a vertical dimension less than the thickness of the formation. In such a case the packer should be set above the bottom water in order to produce hydrocarbons from the portion of the formation having no flowable water and exclude the bottom water.

Figure 2:
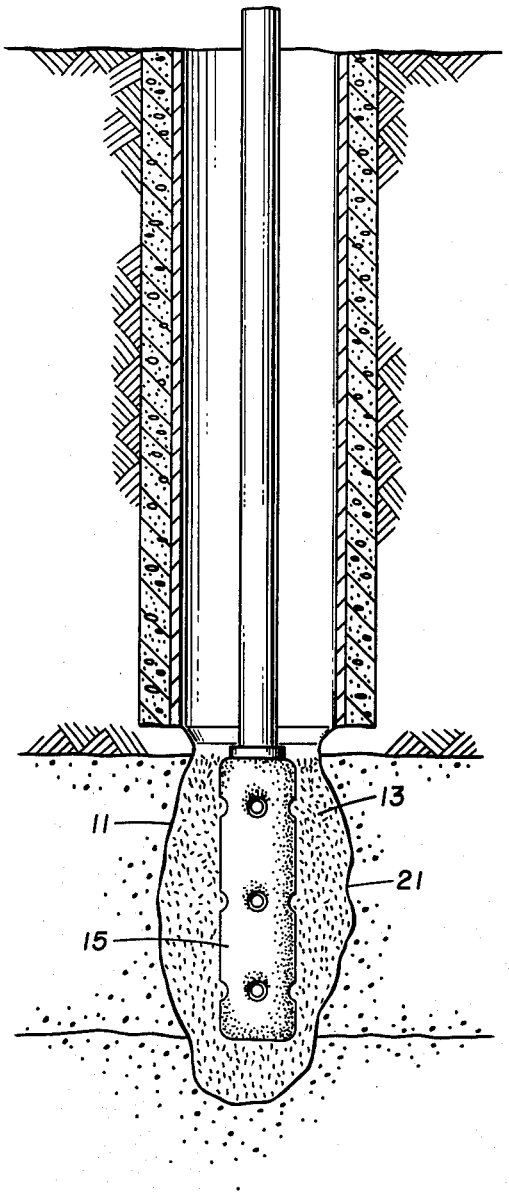
FIG. 2 is a diagrammatic view illustrating another embodiment of this invention.

Another embodiment of this invention is illustrated in FIG. 2. This embodiment is particularly applicable for use in formations wherein the wall 21 of the well is particularly irregular as may result where the cavities 11 are particularly large. In carrying out this embodiment there is formed a mixture of water-wet particles in a nonaqueous fluid. As previously stated, the granular particles used in carrying out this invention have a characteristic of being preferentially water-wet, and, therefore, are normally water-wet in their natural state. However, it may be desirable to pass the granular particles through a water bath, such as a water spray or tank of water, to ensure the thorough wetting by water of the particles, prior to forming the mixture of the water-wet granular particles and nonaqueous fluid. The packer 15 is positioned in the well and the mixture is injected down the well and the water-wet granular particles 13 are deposited about the packer 15 as illustrated in FIG. 2. The mixture may be injected down the well to deposit the water-wet granular particles about the packer by employing techniques which are applicable to forming gravel packs in a well. The water-wet granular particles desirably are of a size within the range of 40–325 U.S. standard sieve mesh. Granular particles of a size within the range of 40–230 U.S. standard sieve mesh, normally referred to as sand, are preferred for use in carrying out this invention though larger size particles may be used. The preferred nonaqueous fluid which is used for entraining the water-wet granular particles is oil. Oil is normally readily available and is compatible with hydrocarbon-bearing formations. After depositing the water-wet granular particles 13 about the packer 15, the packer is expanded and pressure is applied to the water-wet granular particles 13 and the formation in an amount no greater than the overburden pressure. Thereafter, hydrocarbons are produced from the formation via the passageways extending through the packer and sand arches are formed in the formation. It is advantageous to form the sand arches slowly as was previously described in order to minimize the production of sand and thus best form the sand arches to stabilize the formation.

Figure 3:
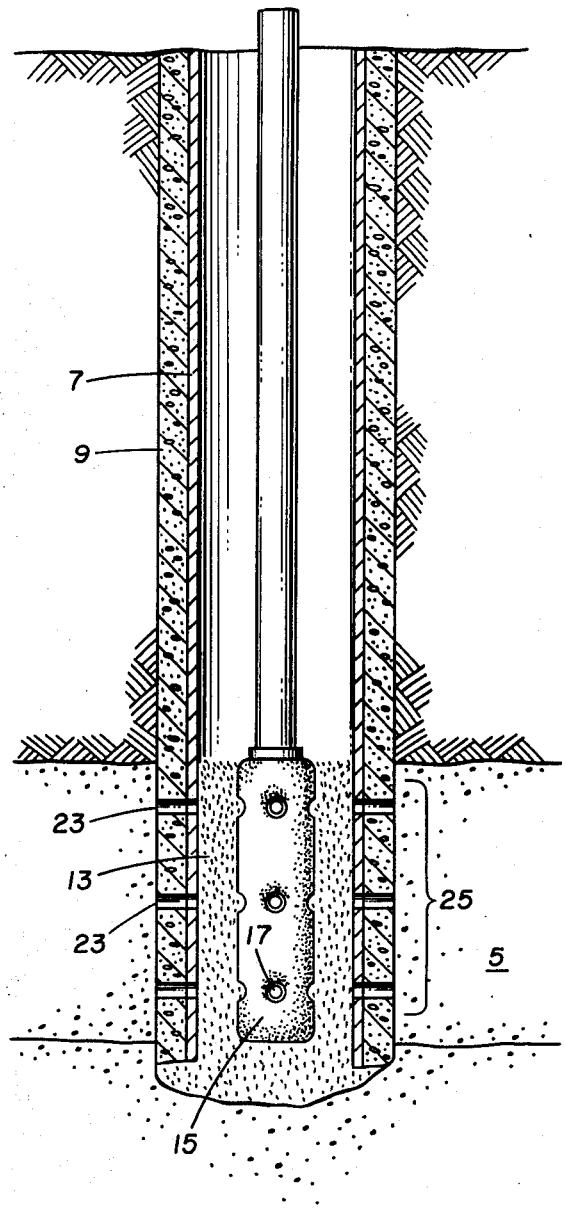
FIG. 3 is a diagrammatic view illustrating a further embodiment of this invention.

In another embodiment of this invention, as illustrated by FIG. 3, the well which extends into the unconsolidated formation 5 is cased and perforations 23 are provided through the casing 7 and cement sheath 9 to provide an open production interval 25. Thereafter the packer 15 is positioned within the well adjacent the open production interval 25 and water-wet granular particles 13 preferably of a size comparable to those particles which make up the unconsolidated formation are positioned in the casing to essentially fill the annulus formed intermediate the packer and the open production interval. Pressure is applied via the packer to the water-wet granular particles 13 in the annulus to stabilize the water-wet granular particles. The greater the pressure applied, the more stable will be the water-wet granular particles, and in this embodiment the upper limit of the pressure which may be applied is the lesser of the bursting strength of the casing and the crushing strength of the sand grains. Thereafter, hydrocarbons are produced from the formation via the open production interval, consolidated water-wet granular particles 13 and lateral passageways 17, into the well and thence recovered therefrom at the surface. As previously described, it is again desirable to produce the hydrocarbons at a sufficiently high rate to form sand arches and in this embodiment the sand arches are formed in the water-wet granular particles which are located in the casing intermediate the packer and the open production interval. The sand arches, in combination with the pressure applied by the packer, stabilize the water-wet granular particles within the annulus and control the production of sand from the formation.

The last-described embodiment is particularly applicable for use in producing hydrocarbons: (1) from shallow unconsolidated formations, that is, formations at depths of less than about 4000 feet, and (2) from formations comprised of silt size or smaller particles. In the case of (1) above, the overburden pressure is low and thus the strength of the unconsolidated formation is low and the rate at which hydrocarbons may be produced from the formation without sand production is low. By application of this last-described embodiment, pressure may be applied to the water-wet granular particles about the packer within the casing in an amount far in excess of the overburden pressure, thus strongly stabilizing the water-wet granular particles about the packer and enabling the production of hydrocarbons from the unconsolidated formations at increased rates without sand problems. In the case of (2) above, the control of the production of sand from formations that are comprised of very fine particles, where the larger sized formation particles approach silt size, on the order of about 200 U.S. standard sieve mesh, has heretofore been very difficult. Normal gravel packs having particles no smaller than about 40 to 60 U.S. standard sieve mesh are ineffective in controlling the production of sand particles of sizes smaller than 200 mesh. Screens having slot sizes small enough to control the production of such small particles are readily plugged during early production from the well and thus are ineffective. This embodiment enables the control of such small sized sand particles. As was previously indicated, it is desirable in this embodiment to employ sand particles previously produced from the formation or in the alternative other particles may be employed of a size of about 200 mesh or less in the casing about the packer. By applying pressure via the packer to the particles intermediate the packer and the casing and forming sand arches therein as previously described these particles are stabilized and thus enable hydrocarbons to be produced from the formation while controlling the production of sand therefrom.

We claim:

1. A method of producing hydrocarbons from an unconsolidated hydrocarbon-bearing formation, said formation being penetrated by a well completed as an open hole and wherein the wall of said open hole adjacent said formation is irregular, comprising the steps of:

a. injecting water-wet granular particles down said well to make regular said wall of said open hole;

b. setting a packer within said well adjacent said formation and against said wall of said open hole made regular, said packer having a plurality of lateral passageways extending through said packer to provide fluid communication intermediate said formation and the interior of said well;

c. applying pressure via said packer to said wall of said open hole made regular in an amount no greater than the overburden pressure on said formation; and d. forming sand arches in said formation to stabilize said formation by 1. producing hydrocarbons at a first rate from said well until sand-free production is attained, 2. repeating step (1) at incrementally higher production rates until a production rate is attained at which sand-free production is no longer attained, and 3. producing hydrocarbons from said formation via said passageways extending through said packer at a rate slightly less than said rate at which said sand-free production is no longer attained.

2. The method of claim 1 wherein said water-wet granular particles are injected down said well as a mixture of water-wet granular particles in a nonaqueous fluid.

3. The method of claim 2 wherein said mixture is comprised of oil and water-wet sand of a size within the range of 40 to 325 U.S. standard sieve mesh.

4. The method of claim 1 wherein prior to step (a) granular particles that have a characteristic of being preferentially water-wet are contacted with an aqueous fluid to water-wet said particles.

5. A method of producing hydrocarbons from an unconsolidated hydrocarbon-bearing formation that is penetrated by a cased well having openings through the casing that provide an open production interval communicating with said formation, comprising:

a. positioning within said casing in said well adjacent said open production interval a packer having a plurality of lateral passageways extending therethrough to provide fluid communication intermediate the inside of said casing and the inside of said packer;

b. positioning water-wet granular particles in said casing to essentially fill the annulus formed intermediate said packer and said open production interval;

c. applying pressure via said packer to said water-wet granular particles in said annulus to stabilize said water-wet granular particles; and d. forming sand arches in said water-wet granular particles to further stabilize said water-wet granular particles.

6. A method of producing hydrocarbons from an unconsolidated hydrocarbon-bearing formation, said formation being penetrated by a well completed as an open hole and wherein the wall of said open hole adjacent said formation is irregular, comprising the steps of:

a. injecting water-wet granular particles down said well to make regular said wall of said open hole;

b. setting a packer within said well adjacent said formation and against said wall of said open hole made regular, said packer having a plurality of lateral passageways extending through said packer to provide fluid communication intermediate the interior of said well and said formation laterally adjacent said perforations extending through said packer;

c. applying pressure via said packer to said wall of said open hole made regular in an amount no greater than the overburden pressure on said formation;

d. forming sand arches adjacent said lateral passageways extending through said packer to stabilize said formation; and e. producing hydrocarbons from said formation via said lateral passageways extending through said packer.

* * * * *